United States Patent [19]

Eistrat

[11] 4,149,367

[45] Apr. 17, 1979

[54] NON-SPECULAR CONDUCTOR AND METHOD OF MAKING SAME

[76] Inventor: Thomas Eistrat, 1020 S. Almansor St., Alhambra, Calif. 91801

[21] Appl. No.: 869,850

[22] Filed: Jan. 16, 1978

[51] Int. Cl.[2] ..... H01B 5/08; D07B 7/12

[52] U.S. Cl. ..... 57/212; 57/223; 57/314; 174/128 R

[58] Field of Search ..... 57/1, 6, 9, 55, 139 R, 57/145, 148, 149, 153, 156 R, 160, 161, 162, 164; 51/410, DIG. 10, 319–321; 174/128 R, 130 R; 15/88, 209

[56] References Cited

U.S. PATENT DOCUMENTS

| | | | |
|---|---|---|---|
| 1,798,316 | 3/1931 | Dreisbach | 51/410 X |
| 2,042,824 | 6/1936 | Brazier | 57/149 |
| 2,071,709 | 2/1937 | Riddle | 57/166 |
| 3,061,997 | 11/1962 | Haugwitz | 57/166 X |
| 3,124,927 | 3/1964 | Mann et al. | 57/148 X |
| 3,217,838 | 11/1965 | Peterson et al. | 57/166 X |
| 3,413,792 | 12/1968 | Werdenberg | 57/9 |
| 3,496,285 | 2/1970 | Slethei | 174/130 |
| 3,760,093 | 9/1973 | Pemberton | 174/128 R |
| 3,906,672 | 9/1975 | Kobayashi | 51/410 |

*Primary Examiner*—Donald Watkins

[57] ABSTRACT

A method of making environmentally approved power lines without entrapment of abrasive blasting ingredients. Each strand to form the top layer of the bare standed non specular conductor is made non specular before it is twisted thru the closing block on the cable strander so that the completed conductor becomes non specular. The preferred method of non specular finishing each strand for the top layer is by means of abrasive blasting.

9 Claims, 2 Drawing Figures

NON-SPECULAR CONDUCTOR AND METHOD OF MAKING SAME

BACKGROUND OF THE INVENTION

1. Field of the invention

Environmental considerations have caused electric public utility companies to install non specular finish bare stranded conductor (also called cable) in overhead distribution and transmission electrical power lines. The non specular surface finish for bare stranded aluminum and aluminum steel reinforced conductor is described in American National Standard C 7.69. A segment of the public objects to seeing overhead power lines.

2. Description of the prior art

The non specular finish commonly used for many years, and now, is obtained by passing the otherwise completed conductor thru an abrasive blasting machine. A typical such abrasive blasting machine is one commonly used for removing mill scale from pipe. This is done as the last process before the conductor is wound onto reels for shipment from manufacturer to user.

Government specifications have limited the acceptance of non specular surface finish bare stranded electrical conductor to that which has "a surface condition when received at the delivery point to be clean and free of sharp edges, scratches, grit, corrosion, excess drawing lubricant and other contaminants".

The effect of entrapped jet blasted abrasive grits on the interior strands of multilayer conductor has been dismissed an unavoidable - one just has to live with this entrapped grit because of the need to manufacture a non specular surface conductor for environmental aesthetic considerations.

Such conductor wears in an outdoor overhead power line installation. Each individual strand is constantly being minutely slided relative an adjacent strand. This constant movement among adjacent strands is due to the wind caused aeolian vibrations. Infrequent galloping of he conductor, as well as expansion and contraction of the conductor due to temperature changes, also causes sliding between adjacent strands.

Each layer of such a multilayer conductor must be so stranded that the completed conductor is flexible. Otherwise it could not be wound onto reels for shipping and installation, nor sagged for strength of installation, nor able to withstand wind and temperature conditions during service. Thrasher for example, is so stranded in the top layer that there is about ⅛ inch in circumference total looseness between strands. Too tight and the conductor is not sufficiently flexible — too loose and it basket-weaves. The required looseness in stranding permits abrasive blasting grits in current methods of making the conductor surface finish non specular to penetrate to interior strands and become permanently embedded or entrapped.

All entrapment of grit caused by the jet grit blasting process currently used is not removable by cleaning. So entrapped grit has been so wedged in entrapment that it cannot be removed by blowing or suction air pressure, or by any known method without destroying the conductor. The abrasive grits used have been commercial blasting grits, including silica sand, aluminum oxide, glass and garnet of about 100 to 300 mesh.

In one sample of new Bluebird non specular finish conductor as now manufactured, the following weight of garnet grit was found remaining from the manufacturing process (in pounds/thousand feet): top layer 0.870; second layer 0.975; third layer 0.195; fourth layer 0.053; steel core 0.012; and total weight being 0.941.

In one sample of new Thrasher non specular finish conductor as now manufactured, the following weight of garnet grit was found remaining from the manufacturing process (in pounds/thousand feet); top layer 0.363; second layer 0.534; third layer 0.041; fourth layer 0.001; steel core 0.002; and total weight being 2.105.

Overhead stranded bare power lines wear out because of weathered particles blown by winds into the conductor during there service life. The abrasive grit particles entrapped during the current manufacturing method for making non specular finish bare stranded conductor causes additional wear during its service life. These grit abrasives are deeper penetrated, sharper, harder, greater in quantity, and more damaging than the wind blown in particles during the service life. Conductor life is thereby shortened. No one knows by how much such conductor life is shortened. The amount and distribution of such permanently by manufacturing process embedded abrasive grits in thousands of miles of conductor so made is unknown. The invention herein solves the problems in the prior art caused by entrapment of abrasive grit particles during manufacture.

SUMMARY OF THE INVENTION

A main object of the invention is to provide a novel and improved process for making stranded non specular surface bare conductor without abrasive blasting the fully stranded conductor to obtain the non specular surface finish. This invention comprises making non specular bare stranded conductor by the method which comprises: making the top layer of the strands for the conductor non specular before twisting these top layer strands thru the final closing block on the cable strander and then completing the stranding of the conductor by pulling and winding onto reels. In this invention the individual top layer strands could be abrasive blasted on the cable strander just before they are pulled thru the closing block. A disadvantage of this process is the need for a grit blasting and cleaning mechanism for each strand that goes into the top layer. In the case of Bluebird this would require 30 such mechanisms. This would be costly to make, install, and maintain. Such would also be the case if the desired surface finish were rolled onto the desired surface (in the case of self damping conductor only one surface being so finished) of each top layer strand while on the cable strander before entering the closing block.

In this invention it is better to have each strand to be used for the top layer of conductor in a non specular surface finish condition when in the bobbins that are to be placed on the cable strander.

These non specular finished strands in this invention can be surface finished as the last operation on the wire drawer before winding on bobbins. The wire drawer generally reduces ⅜ inch rod to the desired size and cross-sectional shape. A compact abrasive grit blasting device can be installed on the wire drawer, followed by a suction and/or wiping and/or solvent cleaning device, and even a strand lubricating device — all just ahead of bobbin winding.

Instead of grit blasting to obtain ANS C 7.69 surface finish on each of the top layer strands, this invention as an alternate includes the surface finish to be rolled on. The finish can likewise be made on the wire drawer.

The rolls may be 3 sets of power driven rolls, set 120 degrees apart, and compressing with tons of pressure in a contour appropriatingly fitting the cross-section of the strand, and with a surface finish the reverse image of the desired ANS C 7.69 finish. The roll surface finish may be a 150 mesh diamond grit bonded on a sintered bed laid on steel rolls. The rolls are set just ahead of the bobbin winder on the wire drawer.

Instead of the ANS C 7.69 surface finish being done while the strand is on the wire drawer it could be done after removing the bobbins from the wire drawer and before they are placed on the cable strander. The strand is run thru a separate machine from the wire drawer, thru similar sets of power driven rolls which roll on the ANS C 7.69 surface finish, then wound onto bobbins and the bobbins placed in the cable strander for stranding the top layer of conductor over lower layers of smooth bright finish strand. No grit is entrapped in non specular conductor made this way.

DESCRIPTION OF PREFERRED EMBODIMENTS

The non specular finish for bare stranded conductor may also be made with this invention of making the top layer of strand for the conductor non specular before it is stranded into the conductor by adding a suitable delustrant to the wire drawing lubricant remaining on these strands to produce an ANS C 7.67 light reflectance.

The non specular finish for bare stranded conductor may also be made with this invention of making the top layer of strand for the conductor non specular before it is stranded into the conductor by anodizing to a non specular finish with a color which substantially blends with the background against which it would be visible when installed overhead as a power having an ANS 7.67 light reflectance.

Figure 1:
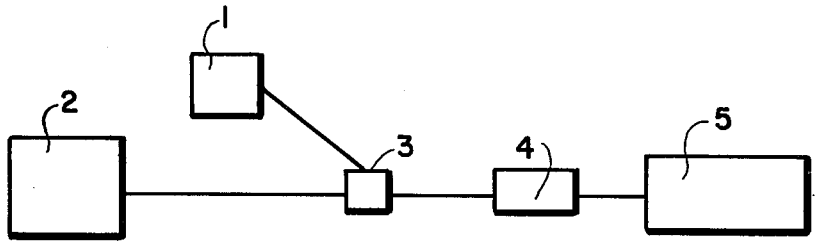
FIG. 1 of the drawings shows a block diagram of the prior art of making non specular bare stranded conductor on a cable strander. Reference block number 1 designates bobbins filled with bright surface finish strand on the cable strander for the top layer of the conductor. Reference block number 2 designates the unfinished stranded conductor below the top layer. Reference block number 3 designates the final closing block on the cable strander, wherein the top layer of bright strands from the bobbins in block 1 are twisted over and cover the unfinished lower layers of conductor from block 2. Reference block number 4 designates an abrasive blasting machine thru which the completely stranded bright stranded bare conductor is passed so as to apply an abrasive blasted non specular surface to the conductor. Reference block number 5 designates the conductor after being passed thru the abrasive blasting machine 4 and wound onto reels for storage and shipment as FIG. 2 of the drawings shows a block diagram of a preferred form of this invention of making non specular stranded bare conductor on a cable strander. Bright aluminum strand is made into bobbins of non specular surface finish strand in abrasive blasting machine reference block number 4; and then these bobbins are used for the top layer strand bobbins reference block number 6 on the cable strander, where they are twisted to cover over the unfinished lower layers of conductor from reference block number 2, thru the final closing block reference block number 3 on the cable strander to form the completed non specular stranded bare conductor, which is then pulled and wound onto reels for storage and shipment as abrasive particle free non specular stranded bare conductor reference block number 7.
Figure 2:
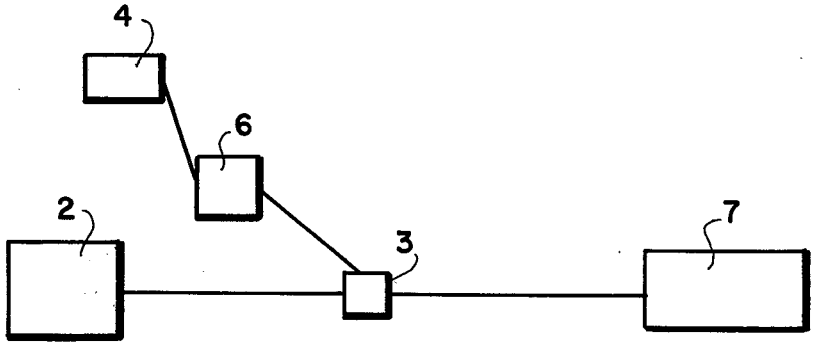

The best mode for carrying out this invention takes into account the cost of installation and other manufacturing costs for the modes of inventions herein disclosed. The best mode for carrying out this invention is that described herein under FIG. 2 of the Brief Description of the Drawings, since the costs involved are negligible and the different modes herein of this invention produce non specular said conductor — all superior to the prior art which produced an abrasive contaminated conductor.

Although the electric power industry non specular surface finish of ANS C7.69 light reflectance is described as the preferred embodiment it is to be understood that there are environments in overhead electric line applications where a duller or brighter non specular light reflectance surface may be preferred as thought to better blend into an environment; and such finish is within the scope of this invention.

I claim:

1. A method of making non-specular bare stranded electrical conductor, which comprises:

(a) making wire for a top layer of strands for a non-specular conductor before feeding said strands thru a final closing block on a cable strander, (b) and the completing a stranding of the conductor so that the completed conductor is non-specular.

2. The method of claim 1, further comprising: making the non-specular wire thereof sufficiently non-specular by abrasive blasting.

3. The method of claim 1, further comprising; making the non-specular wire thereof sufficiently non-specular by rolling on a non-specular finish.

4. The method of claim 1, further comprising: making the non-specular wire thereof sufficiently non-specular by anodizing with a color which substantially blends into the background against which it would be visible when installed outdoors.

5. The method of claim 1 in which the top layer of strands for the conductor are made non specular by adding a delustrant to the lubricant remaining on the strands after wire drawing.

6. A product made by the method of claim 1 further comprising: a conductor having negligable contaminants therein.

7. A product made by the method of claim 1, further comprising: a conductor that is stranded to be self damping.

8. A product made by the method of claim 1, further comprising: a conductor that is stranded to self-damping, and further comprising: having the non-specular wires thereof made sufficiently non-specular by abrasive blasting.

9. The method of claim 1, further comprising: stranding the conductor to be self-damping, and further comprising: making the non-specular wires thereof non-specular by rolling on a non-specular finish.

* * * * *

UNITED STATES PATENT AND TRADEMARK OFFICE

CERTIFICATE OF CORRECTION

PATENT NO. : 4,149,367

DATED : Apr. 17, 1979

INVENTOR(S) : Thomas Eistrat

It is certified that error appears in the above-identified patent and that said Letters Patent are hereby corrected as shown below:

Column 2, line 2, number "0.941" should read -- 2.105 --; and,
Column 2, line 9, number "2.105" should read -- 0.941 --.
In claim 1, column 4, line 30, after and "the" should read -- then --.

Signed and Sealed this

*Seventh* Day of *August 1979*

[SEAL]

*Attest:*

*Attesting Officer*

LUTRELLE F. PARKER

*Acting Commissioner of Patents and Trademarks*